US012392495B2

(12) United States Patent
Beckstead et al.

(10) Patent No.: US 12,392,495 B2
(45) Date of Patent: Aug. 19, 2025

(54) ELECTRIC FIREPLACE WITH INTEGRATED AIR CONDITIONER

(71) Applicant: ARCTIC FLAME FIREPLACES LLC, Kanab, UT (US)

(72) Inventors: Benjamin Larry Beckstead, Kanab, UT (US); Jedediah Seal Beckstead, Erda, UT (US)

(73) Assignee: ARCTIC FLAME FIREPLACES LLC, Kanab, UT (US)

( * ) Notice: Subject to any disclaimer, the term of this patent is extended or adjusted under 35 U.S.C. 154(b) by 163 days.

(21) Appl. No.: 18/092,789

(22) Filed: Jan. 3, 2023

(65) Prior Publication Data

US 2023/0213201 A1 Jul. 6, 2023

Related U.S. Application Data

(60) Provisional application No. 63/296,468, filed on Jan. 4, 2022.

(51) Int. Cl.

| | |
|---|---|
| ***F24C 7/00*** | (2006.01) |
| ***F25B 13/00*** | (2006.01) |
| *F24F 1/0007* | (2019.01) |
| *F24F 5/00* | (2006.01) |

(52) U.S. Cl.

CPC ..... *F24C 7/004* (2013.01); *F25B 13/00* (2013.01); *F24F 1/0007* (2013.01); *F24F 5/0096* (2013.01); *F24F 2221/18* (2013.01)

(58) Field of Classification Search

CPC ..... F24C 7/004; F24C 3/006; F25B 13/00; F24F 1/0007; F24F 5/0096; F24F 2221/18; F24B 1/1808; F21S 10/43; F21S 10/043; F21S 10/046

See application file for complete search history.

(56) References Cited

U.S. PATENT DOCUMENTS

| | | | | |
|---|---|---|---|---|
| 4,132,263 | A | 1/1979 | Stinnett | |
| 5,775,408 | A | 7/1998 | Shimek et al. | |
| 7,422,011 | B2 | 9/2008 | Bachinski et al. | |
| 10,309,671 | B2 | 6/2019 | Nyhof et al. | |
| 2005/0076903 | A1 | 4/2005 | Briere | |
| 2009/0245353 | A1 | 10/2009 | Choi et al. | |
| 2012/0202415 | A1* | 8/2012 | Rudd | F24F 7/06 454/338 |
| 2013/0233841 | A1* | 9/2013 | Gallo | H04N 5/64 219/201 |
| 2018/0010819 | A1* | 1/2018 | Nyhof | F24F 1/0003 |
| 2020/0340696 | A1* | 10/2020 | Nyhof | F24F 11/88 |

FOREIGN PATENT DOCUMENTS

| | | | | |
|---|---|---|---|---|
| GB | 2459927 A | * | 11/2009 | F24C 3/006 |
| GB | 2516127 A | * | 1/2015 | F24B 1/1808 |
| WO | WO-2013014455 A1 | * | 1/2013 | F24B 1/1808 |

* cited by examiner

*Primary Examiner* — Joseph F Trpisovsky

(74) *Attorney, Agent, or Firm* — Kunzler Bean & Adamson

(57) ABSTRACT

Apparatuses, systems, methods, and computer program products for an electric fireplace are described. An apparatus may include an electronic display configured to display one or more flame visualizations. An apparatus may include a heat source coupled to the electronic display and configured to heat a surrounding environment. An apparatus may include a cooling source coupled to the electronic display and configured to cool the surrounding environment, the electronic display, the heat source, and the cooling source sharing a single power source.

18 Claims, 5 Drawing Sheets

ELECTRIC FIREPLACE WITH INTEGRATED AIR CONDITIONER

CROSS-REFERENCES TO RELATED APPLICATIONS

This application claims the benefit of U.S. Provisional Patent Application No. 63/296,468 entitled "HVAC (Heating Ventilation Air Conditioning) AC Heat Pump Electric Fireplace" and filed on Jan. 4, 2022 for Benjamin Larry Beckstead, et al., which is incorporated herein by reference in its entirety for all purposes.

FIELD

This invention relates to electric fireplaces and more particularly relates to electric fireplaces with air conditioning.

BACKGROUND

Electric fireplaces can be convenient, easy to install, and aesthetically pleasing. However, in areas where air conditioning is also desirable, air-conditioning units may not be as aesthetically pleasing, typically comprising large plastic boxes installed in a window or on a wall.

SUMMARY

Apparatuses for an electric fireplace with an integrated air conditioner are presented. In one embodiment, an electronic display is configured to display one or more flame visualizations. A heat source, in some embodiments, is coupled to an electronic display and configured to heat a surrounding environment. A cooling source, in a further embodiment, is coupled to an electronic display and configured to cool a surrounding environment. An electronic display, a heat source, and a cooling source, in certain embodiments, share a single power source.

Systems for an electric fireplace with an integrated air conditioner are presented. An electric fireplace, in one embodiment, includes an electronic display configured to display one or more flame visualizations, a heat source coupled to the electronic display and configured to heat a surrounding environment, and a cooling source coupled to the electronic display and configured to cool the surrounding environment. An electronic display, a heat source, and a cooling source, in some embodiments, share a single electric power source. One or more head units, in certain embodiments, are spatially offset from an electric fireplace. One or more head units, in one embodiment, comprise an additional heat source configured to heat a surrounding environment and an additional cooling source configured to cool the surrounding environment.

Computer program products are disclosed comprising computer program code stored on a non-transitory computer readable storage medium. Computer program code, in certain embodiments, is executable by a processor to perform operations. An operation, in one embodiment, includes displaying one or more flame visualizations on an electronic display. An operation, in a further embodiment, includes selectively heating a surrounding environment using a heat source coupled to an electronic display. An operation, in some embodiments, includes selectively cooling a surrounding environment using a cooling source coupled to an electronic display. An electronic display, a heat source, and a cooling source, in one embodiment, share a single power source.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Aspects of the present invention are described herein with reference to system diagrams, flowchart illustrations, and/or block diagrams of methods, apparatuses, systems, and computer program products according to embodiments of the invention. It will be understood that blocks of the flowchart illustrations and/or block diagrams, and combinations of blocks in the flowchart illustrations and/or block diagrams, can be implemented by computer readable program instructions.

Figure 1:
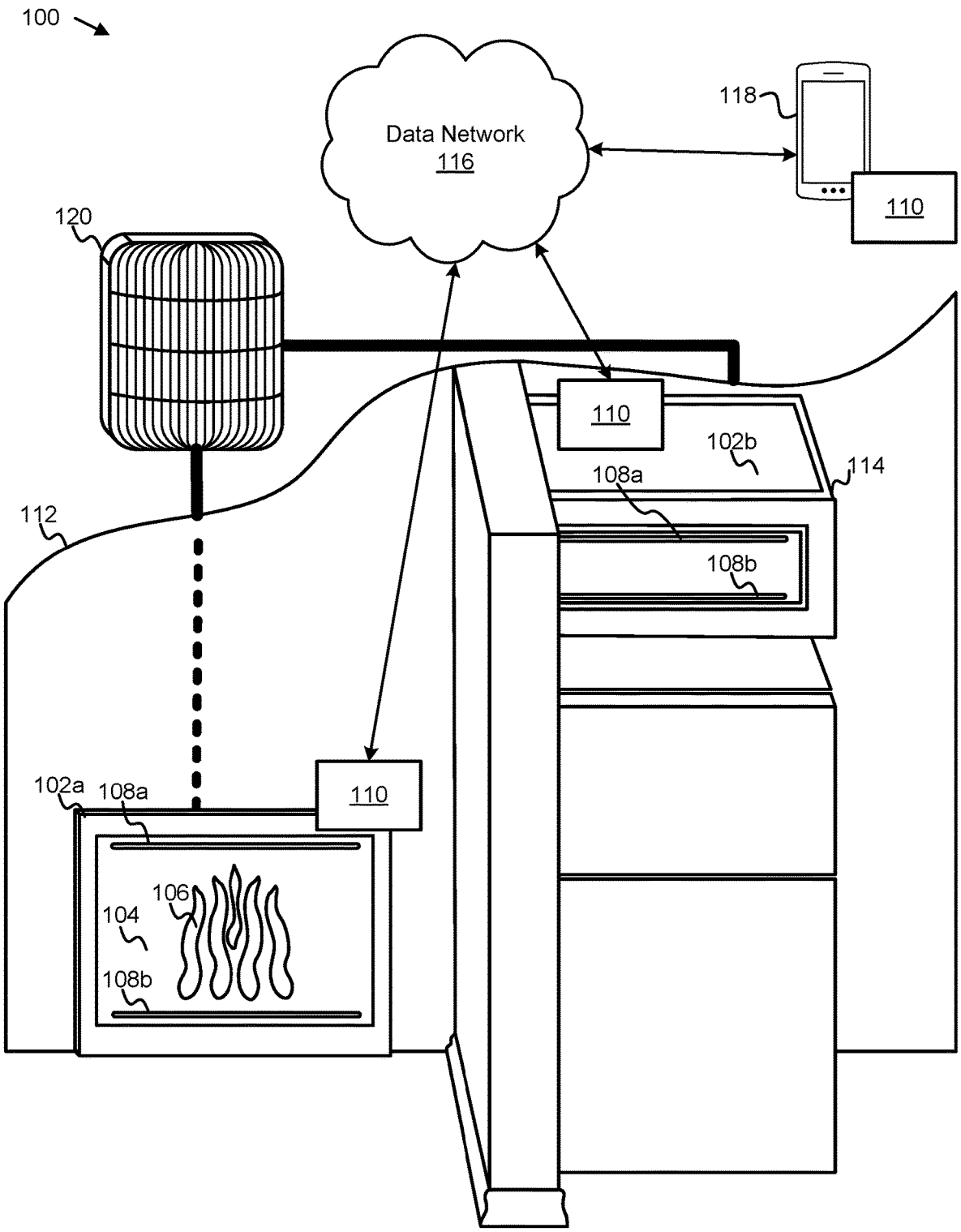
FIG. 1 is a perspective view illustrating one embodiment of a system for an electric fireplace with integrated air-conditioning.

FIG. 1 depicts one embodiment of a system 100 for an electric fireplace 102 with an integrated air conditioner. The system 100, in the depicted embodiment, includes an electric fireplace 102*a*, a head unit 102*b*, one or more controllers 110, a building 112 with a cabinet 114, a data network, a computing device 118, and an outdoor unit 120.

In general, the electric fireplace 102*a* and/or the separate head unit 102*b* of the system 100 may comprise both a heat source and a cooling source (e.g., a heat pump configured to alternatively heat and/or cool a surrounding environment in different modes, or the like). The electric fireplace 102*a*, in the depicted embodiment, comprises an electronic display 104, configured to display one or more flame visualizations 106 and/or other visualizations. In this manner, in certain embodiments, the system 100 may provide both heating and cooling from the same electric fireplace 102*a*, behind an attractive, aesthetically pleasing display 104 with a dynamic visualization 106, instead of requiring a separate plastic box of an air conditioning unit on a wall or in a window.

The electric fireplace 102*a*, in the depicted embodiment, includes an electronic display 104 with a flame visualization 106, a return vent 108*a*, a supply vent 108*b*, and a controller 110. In one embodiment, the electronic display 104 comprises an illuminated display such that the flame visualization 106 and/or one or more other visualizations are illuminated. For example, in various embodiments, the electronic display 104 may comprise one or more light bulbs, a light-emitting diode (LED) screen, a liquid-crystal display (LCD) screen, a plasma screen, an organic LED (OLED) screen, an electroluminescent display screen, a quantum-dot LED screen, an electronic ink screen, or the like.

In some embodiments, the electronic display 104 is configured to display a dynamic and/or animated flame visualization 106 (e.g., with moving and/or animated flames 106, or the like). In other embodiments, electronic display 104 and/or the flame visualization 106 may be substantially static (e.g., a drawing, painting, stamp, photo, print, cutout, streamers, foil or mirror and/or another reflective material, an artificial log, a log set, stone and/or rocks, crystals, glass, a three dimensional display, a flat two dimensional display, or the like) and one or more electronic lights, fans/blowers, or the like may actuate and/or give an appearance of movement to the substantially static flame visualization 106 (e.g., lights blinking and/or moving, a fan/blower moving illuminated streamers, or the like).

In certain embodiments, instead of or in addition to a flame visualization 106, the electronic display 104 may display one or more other visualizations (e.g., a wind visualization, an ocean visualization, an outdoor landscape visualization, a sunrise or sunset visualization, a photo slideshow visualization, or the like). The electronic display 104, in a further embodiment, may comprise a television and/or display monitor, or the like, with one or more video and/or audio inputs (e.g., HDMI, DVI, DisplayPort, VGA, RCA, coaxial, or the like), a broadcast television antenna, or the like.

As described in greater detail below, in some embodiments, the controller 110 may dynamically customize and/or adjust the flame visualization 106 based on a mode of the electric fireplace 102*a* (e.g., a heating mode, a cooling mode, or the like). For example, the electronic display 104 may display a flame visualization 106 comprising a warm color hue (e.g., one or more of a yellow, orange, and/or red hue, or the like) during a heating mode, may display a flame visualization 106 comprising a cool color hue (e.g., one or more of a blue, green, and/or magenta hue, or the like) during a cooling mode, or the like. In certain embodiments, the controller 110 may also play one or more sounds associated with a mode of the electric fireplace 102*a* using one or more speakers associated with the electronic display 104 (e.g., sounds of a crackling fire during a heating mode, sounds of wind and/or a storm in a cooling mode, or the like).

In certain embodiments, the electric fireplace 102*a* includes a return vent 108*a* and a supply vent 108*b*. In the depicted embodiment, the return vent 108*a* and the supply vent 108*b* are both disposed in a surface of the electronic display 104 (e.g., a front surface through which the electronic display 104 is visible, through which the flame visualization is visible, or the like such as a glass surface, a plastic or other polymer surface, or the like). The electric fireplace 102*a* may comprise one or more fans, blowers, or the like to draw air in through one or more supply vents 108*b* and to force the air (e.g., after the electric fireplace 102*a* has heated or cooled the air) out through one or more return vents 108*a*.

By disposing one or more vents 108 in a front surface of the electric fireplace 102*a* and/or the electronic display 104, in some embodiments, the electric fireplace 102*a* may be installed flush and/or substantially flush with a wall of the building 112, or the like. In other embodiments, one or more vents 108 may be disposed in one or more side surfaces (e.g., a top surface, a bottom surface, a left surface, a right surface, or the like) of the electric fireplace 102*a*, perpendicular to the front surface and/or the electronic display 104, and the electric fireplace 102*a* may be installed extending at least partially out from a wall of the building 112 (e.g., instead of being flush) to accommodate the one or more vents 108.

The electric fireplace 102*a* and/or the head unit 102*b*, in certain embodiments, include both a heat source and a cooling source. Both a heat source and a cooling source, in one embodiment, may be mechanically coupled to (e.g., within a single housing, mounted behind, or the like) the electronic display 104 of the electric fireplace 102*a*.

In one embodiment, the heat source and the cooling source comprise a single heat pump (e.g., a split system air conditioner, a direct-current (DC) inverter heat pump, or the like) configured to both heat the surrounding environment in a heating mode and to cool the surrounding environment in a cooling mode. For example, the electric fireplace 102*a* and/or the head unit 102*b* may comprise an indoor unit (e.g., with an evaporator coil, an expansion valve, a fan, or the like) in fluid communication (e.g., through one or more refrigerant lines) with an outdoor unit 120 (e.g., with a compressor, condenser coil, fan, or the like).

In some embodiments, a reversing valve is disposed between the electric fireplace 102*a* and/or the head unit 102*b* and the outdoor unit 120, to reverse the flow of refrigerant between them to switch between a heating mode and a cooling mode (e.g., in response to a signal from a controller 110, or the like). The heat source and/or the cooling source, in various embodiments, may include a DC inverter heat pump, an air-source heat pump, a ground-source and/or geothermal heat pump, an absorption heat pump, a closed-loop heat pump, an open-loop heat pump, a reverse cycle chiller, a cold climate heat pump, or the like.

In one embodiment, the electronic display 104, the heat source, and the cooling source share a single power source, such as an electric power source or the like (e.g., without requiring a combustible fuel source to heat the surrounding environment, or the like). In some embodiments, an electric fireplace 102*a* and/or a head unit 102*b* may also comprise a secondary heat source (e.g., supplemental heating, electric heating coils, a backup burner, or the like) to temporarily heat and/or defrost coils in response to the reversing valve switching modes, or the like.

In some embodiments, a single outdoor unit 120 may be in communication with (e.g., through one or more refrigerant lines) and/or otherwise connect to multiple electric fireplaces 102*a* and/or head units 102*b*. In another embodiment, a system 100 may include multiple outdoor units 120 for multiple electric fireplaces 102*a* and/or head units 102*b*.

In certain embodiments, one or more controllers 110 may be configured to govern and/or control one or more operations of the system 100 (e.g., of an electric fireplace 102*a*, a head unit 102*b*, a computing device 118, or the like). For example, in some embodiments, a controller 110 may comprise logic hardware such as one or more of a processor (e.g., a CPU, a microcontroller, firmware, microcode, an application specific integrated circuit (ASIC), a field programmable gate array (FPGA) or other programmable logic, or the like), a volatile memory, non-volatile computer readable storage medium, a network interface, a printed circuit board, or the like. A controller 110, in further embodiments, may include computer program code stored on a non-transitory computer readable storage medium, executable by a processor to perform one or more of the operations described herein with regard to the electric fireplace 102*a* and/or the head unit 102*b*, or the like.

A controller 110, in one embodiment, may be in communication with one or more of a heat source, a cooling source, an electronic display 104, or the like (e.g., and may send one or more control signals, commands, or the like). In some embodiments, a controller 110 may be configured to display one or more flame visualizations 106 on the electronic display 104 (e.g., a first flame visualization 106 during a heating mode, a second flame visualization during a cooling mode, a warm color hue such as yellow/orange/red during a heating mode, a cool color hue such as blue/green/magenta during a cooling mode, or the like).

A controller 110, in certain embodiments, may determine a mode for an electric fireplace 102*a* and/or a head unit 102*b* (e.g., a heating mode, a cooling mode, a temperature setting, or the like) based on user input. For example, a controller 110 may receive user input from a thermostat disposed on a wall of the building 112, from a remote control device (e.g., an infrared remote control, a radio frequency remote control, a Bluetooth® remote control, or the like), from a user interface of a computing device 118 over a data network 116 (e.g., a mobile computing device such as a smartphone, a smart watch, a tablet, a laptop, or the like; a desktop computer; a gaming device; a set-top box; and/or another computing device 118 comprising a processor and a memory). In some embodiments, a controller 110 may actuate a reversing valve of a heat pump to turn on a heat source in a heating mode in response to a temperature being at or below a heating threshold, may actuate a reversing valve of a heat pump to turn on a cooling source in a cooling mode in response to a temperature being at or above a cooling threshold, or the like.

The system 100, in one embodiment, includes multiple electric fireplaces 102*a* and/or head units 102*b* (e.g., spatially offset in different rooms and/or other locations of the building 112, or the like), each with an additional heat source and/or cooling source (e.g., a heat pump, or the like). In the depicted embodiment, multiple electric fireplaces 102*a* and/or head units 102*b* are connected to the same outdoor unit 120. Multiple controllers 110, in some embodiments, may communicate and/or coordinate to share one or more settings, statuses, thermometer and/or other sensor readings, or the like.

In the depicted embodiment, a head unit 102*b* is disposed in a cabinet 114 (e.g., above a refrigerator). In other embodiments, a head unit 102*b* may be installed and/or disposed in a ceiling, in a kitchen island, in a closet, in a cupboard, on a wall, in a window, or the like. Multiple electric fireplaces 102*a* and/or head units 102*b* may be strategically disposed in different locations around the building 112 to provide a complete distributed heating and/or cooling solution, either as a retrofit solution or as the building 112 is being newly constructed.

The data network 116, in one embodiment, includes a digital communication network that transmits digital communications. The data network 116 may include a wireless network, such as a wireless cellular network, a local wireless network, such as a Wi-Fi network, a Bluetooth® network, a near-field communication (NFC) network, an ad hoc network, or the like. The data network 116 may include a wide area network (WAN), a local area network (LAN), an optical fiber network, the internet, or other digital communication network. The data network 116 may include a combination of two or more networks. The data network 116 may include one or more servers, routers, switches, and/or other networking equipment.

One or more electric fireplaces 102*a*, head units 102*b*, and/or computing devices 118 may be in communication over a data network 116, either directly or through a backend server computing device, or the like. A controller 110 executing on a computing device 118 (e.g., computer executable program code, an installable application, a mobile application, or the like), in some embodiments, may provide a user interface for a user to perform one or more actions for one or more electric fireplaces 102*a* and/or head units 102*b*. For example, a controller 110 may present a graphical user interface on a display screen of a computing device 118 enabling a user to set a desired temperature for a surrounding environment (e.g., a room, a floor, or other location) of the building 112, to set a mode (e.g., a heating mode, a cooling mode, a combined heating and cooling mode, or the like), to select a visualization 106, to set a timer for heating and/or cooling, or the like.

Figure 2:
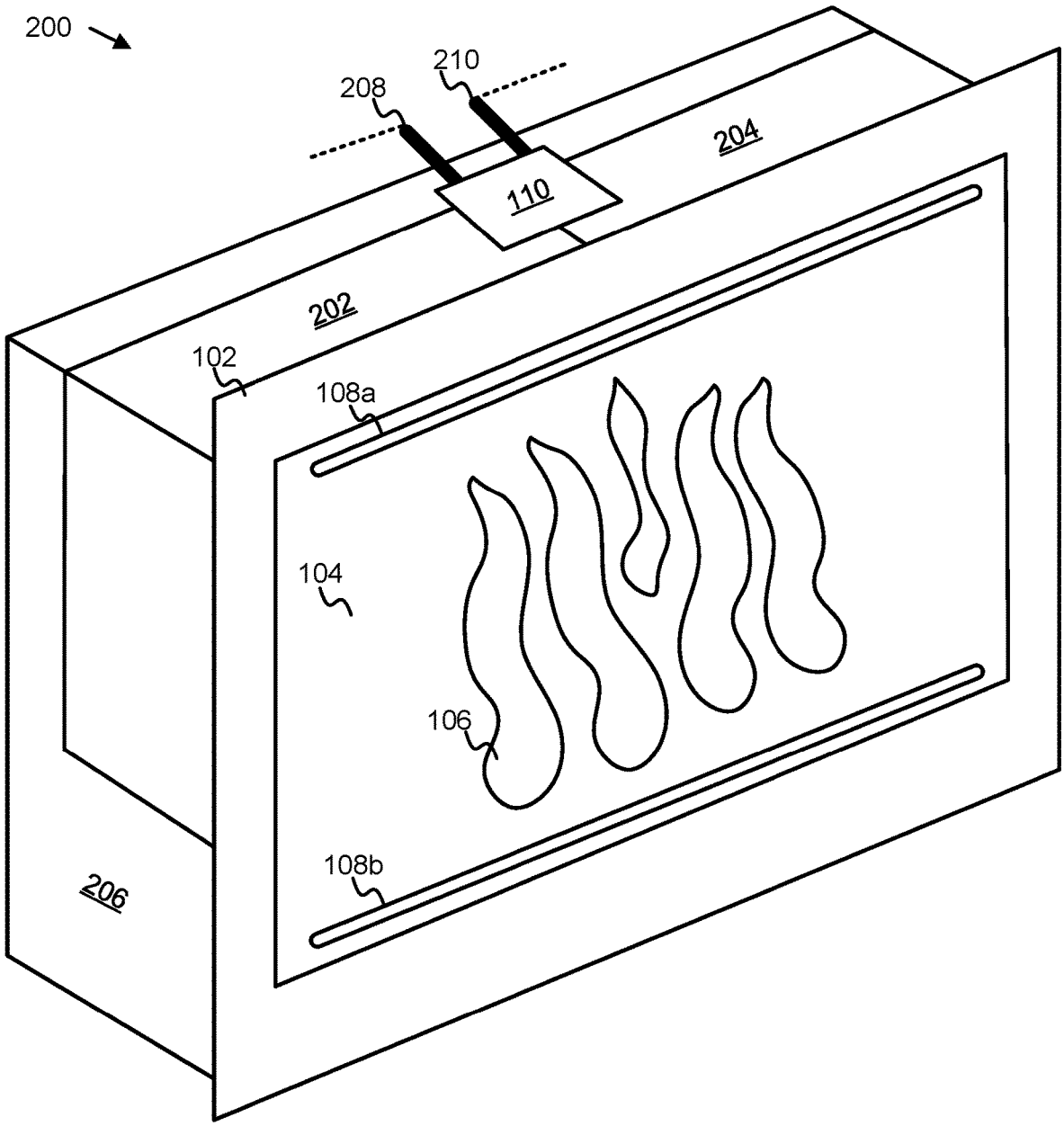
FIG. 2 is a perspective view illustrating a further embodiment of a system for an electric fireplace with integrated air-conditioning.

FIG. 2 depicts one embodiment of a system 200 for an electric fireplace 102 with integrated air-conditioning. The electric fireplace 102 of FIG. 2, in some embodiments, may be substantially similar to the electric fireplace 102*a* described above with regard to FIG. 1. In the depicted embodiment, the electric fireplace 102 includes an electronic display 104 with a flame visualization 106 and one or more vents 108*a-b*, a heat source 202, a cooling source 204, a duct 206, an outside unit interface 208, and a power source interface 210.

In one embodiment, as described above with regard to FIG. 1, a heat source 202 and a cooling source 204 may be combined/integrated as a single heat pump. In other embodiments, a heat source 202 may comprise an electric heating coil, a forced air furnace (e.g., with a combustible fuel source), or the like and a cooling source 204 may comprise a central air conditioner (e.g., a ducted system), a hybrid and/or dual fuel air conditioner, or the like.

In one embodiment, a duct 206 is disposed to direct air between the supply vent 108*b*, past the heat source 202 and/or the cooling source 204, and out the return vent 108*a*, or the like. The duct 206 may comprise a channel, a guide, a cavity, and/or another opening providing fluid communication between one or more vents 108*a-b* and the heat source 202 and/or the cooling source 204. The duct 206 may comprise a durable material, such as a metal, a plastic or other polymer, a ceramic, a glass, a composite material, or the like. In some embodiments, the duct 206 may comprise a plastic or other polymer material rather than a metal, as the heat source 202 may not be configured to reach as high a temperature as a furnace and/or burner that uses a combustible fuel source, or the like.

In one embodiment, an outside unit interface 208 may comprise one or more tubes and/or pipes in communication with an outside unit 120 (e.g., in fluid communication to transport refrigerant, or the like). An outside unit interface 208 may be in communication with a compressor, an expansion device, a reversing valve, or the like (e.g., either as part of an electric fireplace 102*a*, a head unit 102*b*, an outside unit 120, or the like). In one embodiment, a power source interface 210 may comprise an electrical interface such as an electrical plug, an electrical cord, a hard-wired electrical interface, or the like. In other embodiments, a power source interface 210 may comprise a gas line or other interface to a combustible fuel source (e.g., a non-electric fuel source, as a supplement and/or backup to an electric power source, in place of an electric power source, or the like).

Figure 3:
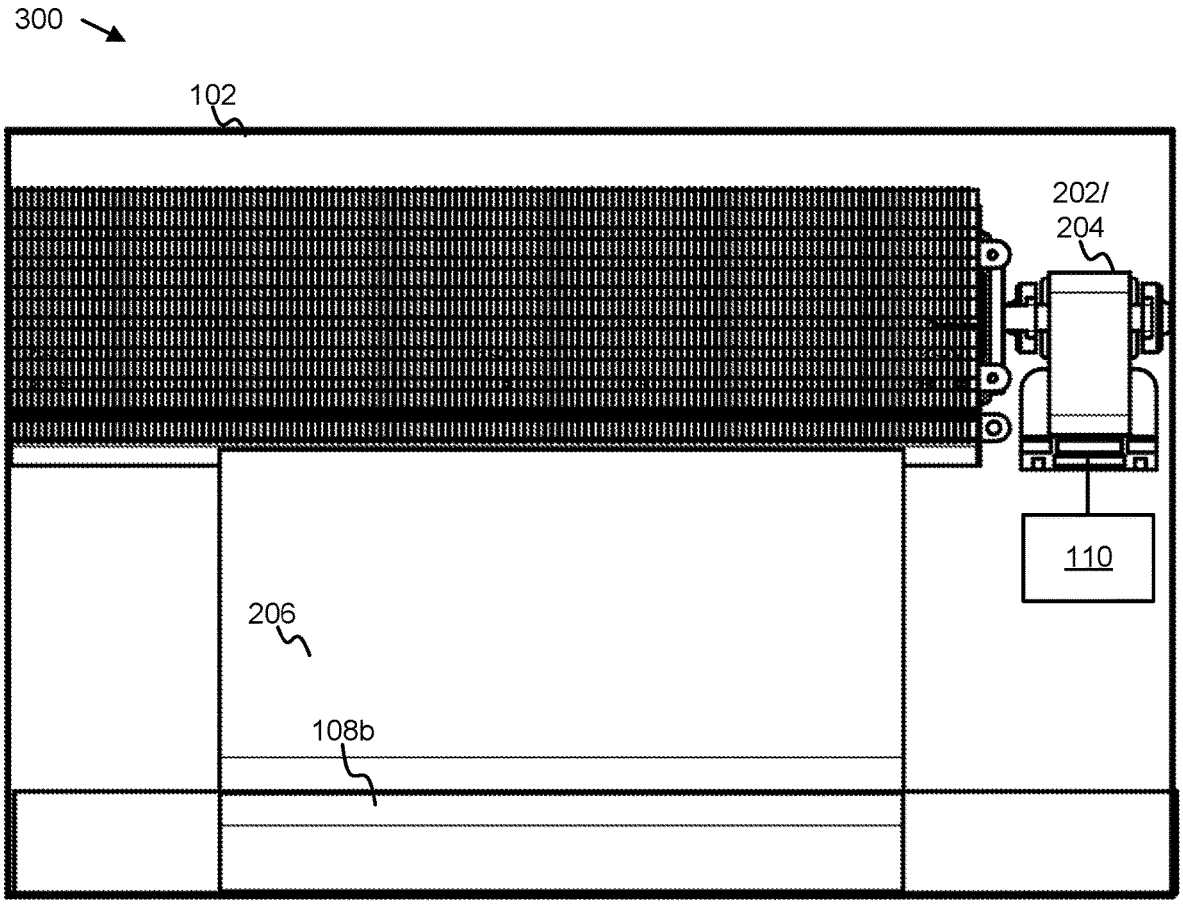
FIG. 3 is a cutaway front view illustrating one embodiment of an electric fireplace with integrated air-conditioning.
Figure 4:
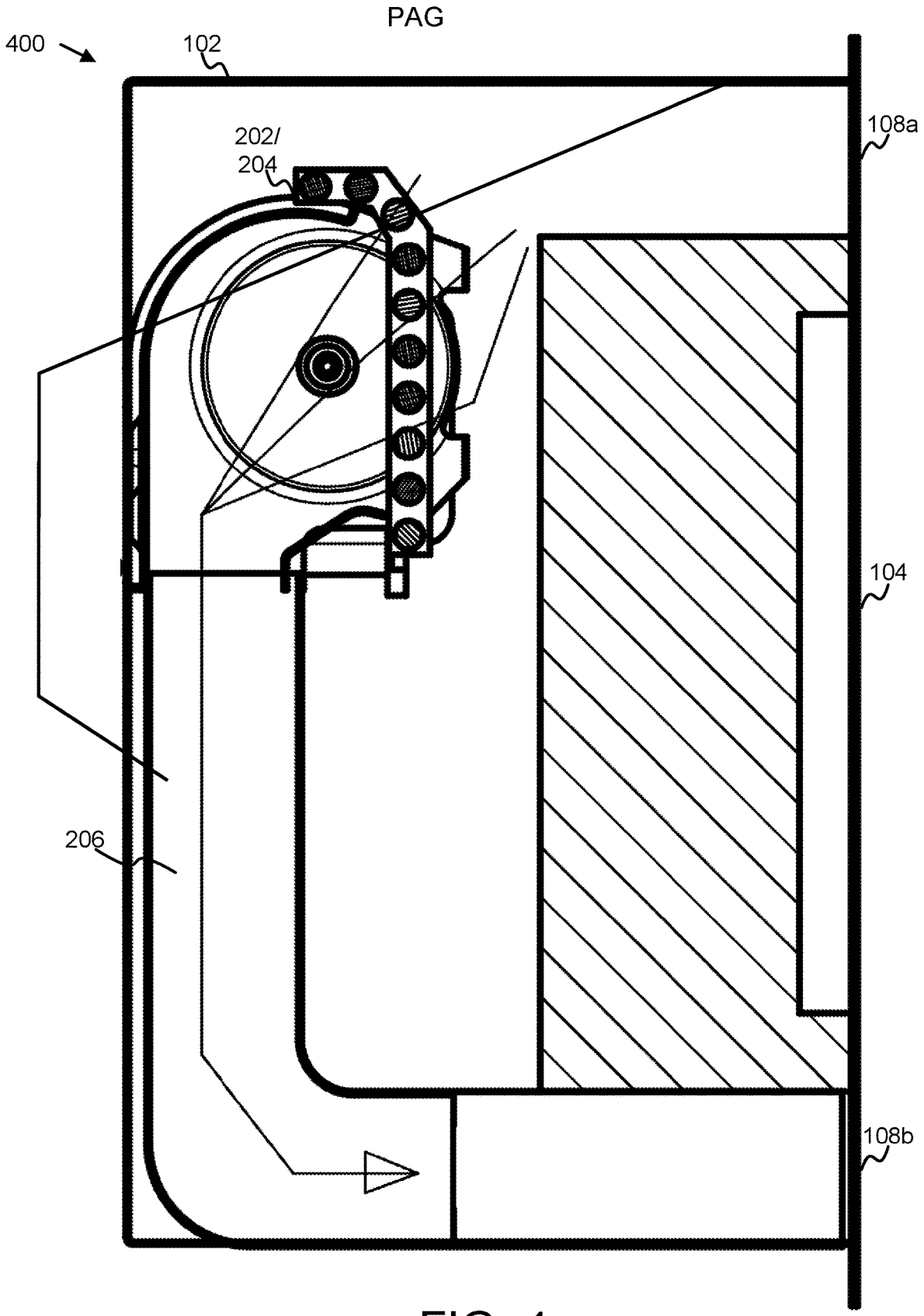
FIG. 4 is a cutaway side view illustrating one additional embodiment of an electric fireplace with integrated air-conditioning.

FIG. 3 depicts one embodiment 300 of a cutaway front view of an electric fireplace 102 with integrated air-conditioning and FIG. 4 depicts one embodiment 400 of a cutaway side view of an electric fireplace 102. The electric fireplace 102 of FIG. 3 and/or of FIG. 4, in some embodiments, may be substantially similar to one or more of the electric fireplace 102*a* of FIG. 1 and/or the electric fireplace 102 of FIG. 2. The depicted embodiment 300 of FIG. 3 comprises a cutaway front view with the electronic display 104 removed and the depicted embodiment 400 of FIG. 4 comprises a cutaway side view.

The electric fireplace 102 includes a combined heat source 202 and cooling source 204 that comprises a heat pump with a fan, blower, or other air mover (e.g., that sucks air through the supply vent 108*b*, into the duct 206, and out the return vent 108*a*) and an evaporator coil or other heat exchanger that heats the air in a heating mode and cools the air in a cooling mode (e.g., depending on a state of a reversing valve, a compressor, or the like as commanded by the controller 110).

Figure 5:
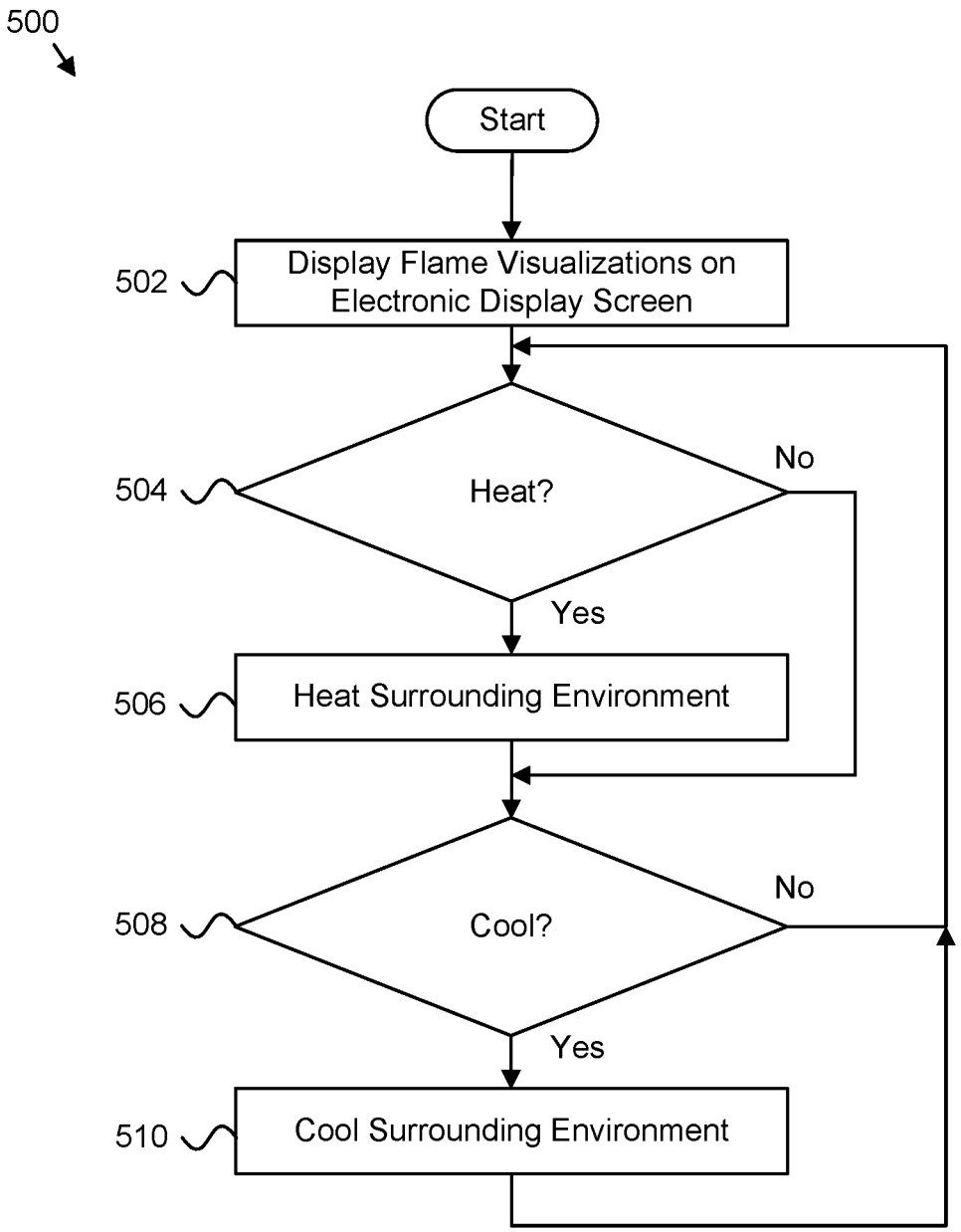
FIG. 5 is a schematic flow chart diagram illustrating one embodiment of a method for an electric fireplace with integrated air-conditioning.

FIG. 5 depicts one embodiment of a method 500 for an electric fireplace 102 with integrated air-conditioning. The method 500 begins and a controller 110 displays 502 one or more flame visualizations 106 on an electronic display 104.

A controller 110 determines 504 whether or not to initiate a heating mode (e.g., based on user input, a temperature satisfying a heating threshold, a setting, a reading from a thermometer or other temperature sensor, or the like). If the controller 110 determines 504 to initiate a heating mode, the controller 110 selectively heats 506 a surrounding area using a heat source 202 coupled to the electronic display 104.

A controller 110 determines 508 whether or not to initiate a cooling mode (e.g., based on user input, a temperature satisfying a cooling threshold, a setting, a reading from a thermometer or other temperature sensor, or the like). If the controller 110 determines 508 to initiate a cooling mode, the controller 110 selectively cools 510 a surrounding area using a cooling source 204 coupled to the electronic display 104. The method 500 continues, with a controller 110 continuing to determine 504, 508 when to initiate heating and/or cooling modes.

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

Furthermore, the described features, advantages, and characteristics of the embodiments may be combined in any suitable manner. One skilled in the relevant art will recognize that the embodiments may be practiced without one or more of the specific features or advantages of a particular embodiment. In other instances, additional features and advantages may be recognized in certain embodiments that may not be present in all embodiments. These features and advantages of the embodiments will become more fully apparent from the following description and appended claims or may be learned by the practice of embodiments as set forth hereinafter.

As will be appreciated by one skilled in the art, aspects of the present invention may be embodied as a system, method, and/or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the present invention may take the form of a computer program product embodied in one or more computer readable medium(s) having program code embodied thereon.

Many of the functional units described in this specification have been labeled as modules to emphasize their implementation independence more particularly. For example, a module may be implemented as a hardware circuit comprising custom very large scale integrated ("VLSI") circuits or gate arrays, off-the-shelf semiconductor circuits such as logic chips, transistors, or other discrete components. A module may also be implemented in programmable hardware devices such as an FPGA, programmable array logic, programmable logic devices or the like.

Modules may also be implemented in software for execution by various types of processors. An identified module of program code may, for instance, comprise one or more physical or logical blocks of computer instructions which may, for instance, be organized as an object, procedure, or function. Nevertheless, the executables of an identified module need not be physically located together but may comprise disparate instructions stored in different locations which, when joined logically together, comprise the module and achieve the stated purpose for the module.

Indeed, a module of program code may be a single instruction, or many instructions, and may even be distributed over several different code segments, among different programs, and across several memory devices. Similarly, operational data may be identified and illustrated herein within modules and may be embodied in any suitable form and organized within any suitable type of data structure. The operational data may be collected as a single data set or may be distributed over different locations including over different storage devices, and may exist, at least partially, merely as electronic signals on a system or network. Where a module or portions of a module are implemented in software, the program code may be stored and/or propagated on in one or more computer readable medium(s).

The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a server, cloud storage (which may include one or more services in the same or separate locations), a hard disk, a solid state drive ("SSD"), an SD card, a random access memory ("RAM"), a read-only memory ("ROM"), an erasable programmable read-only memory ("EPROM" or Flash memory), a static random access memory ("SRAM"), a Blu-ray disk, a memory stick, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network, a personal area network, a wireless mesh network, and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture ("ISA") instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the C programming language or similar programming languages.

The computer readable program instructions may execute entirely on the user's computer, partly on the user's computer, as a stand-alone software package, partly on the user's computer and partly on a remote computer or service or entirely on the remote computer or server or set of servers. In the latter scenario, the remote computer may be connected to the user's computer through any type of network, including the network types previously listed. Alternatively, the connection may be made to an external computer (for example, through the Internet using an Internet Service Provider). In some embodiments, electronic circuitry including, for example, programmable logic circuitry, FPGA, or programmable logic arrays ("PLA") may execute the computer readable program instructions by utilizing state information of the computer readable program instructions to personalize the electronic circuitry to perform aspects of the present invention.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The schematic flowchart diagrams and/or schematic block diagrams in the Figures illustrate the architecture, functionality, and operation of possible implementations of apparatuses, systems, methods, and computer program products according to various embodiments of the present invention. In this regard, each block in the schematic flowchart diagrams and/or schematic block diagrams may represent a module, segment, or portion of code, which comprises one or more executable instructions of the program code for implementing the specified logical functions.

It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Other steps and methods may be conceived that are equivalent in function, logic, or effect to one or more blocks, or portions thereof, of the illustrated Figures.

Although various arrow types and line types may be employed in the flowchart and/or block diagrams, they are understood not to limit the scope of the corresponding embodiments. Indeed, some arrows or other connectors may be used to indicate only the logical flow of the depicted embodiment. For instance, an arrow may indicate a waiting or monitoring period of unspecified duration between enumerated steps of the depicted embodiment. It will also be noted that each block of the block diagrams and/or flowchart diagrams, and combinations of blocks in the block diagrams and/or flowchart diagrams, can be implemented by special purpose hardware-based systems that perform the specified functions or acts, or combinations of special purpose hardware and program code.

As used herein, a list with a conjunction of "and/or" includes any single item in the list or a combination of items in the list. For example, a list of A, B and/or C includes only A, only B, only C, a combination of A and B, a combination of B and C, a combination of A and C or a combination of A, B and C. As used herein, a list using the terminology "one or more of" includes any single item in the list or a combination of items in the list. For example, one or more of A, B and C includes only A, only B, only C, a combination of A and B, a combination of B and C, a combination of A and C or a combination of A, B and C. As used herein, a list using the terminology "one of includes one and only one of any single item in the list. For example, "one of A, B and C" includes only A, only B or only C and excludes combinations of A, B and C. As used herein, "a member selected from the group consisting of A, B, and C," includes one and only one of A, B, or C, and excludes combinations of A, B, and C." As used herein, "a member selected from the group consisting of A, B, and C and combinations thereof" includes only A, only B, only C, a combination of A and B, a combination of B and C, a combination of A and C or a combination of A, B and C.

Means for performing the steps described herein, in various embodiments, may include one or more of a network interface, a controller (e.g., a CPU, a processor core, an FPGA or other programmable logic, an ASIC, a microcontroller, and/or another semiconductor integrated circuit device), a heat source, a cooling source, an electronic display, a hardware appliance or other hardware device, other logic hardware, and/or other executable code stored on a computer readable storage medium. Other embodiments may include similar or equivalent means for performing the steps described herein.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus, comprising:

a single housing comprising:

an electronic display configured to display one or more flame visualizations;

a heat source coupled to the electronic display and configured to heat a surrounding environment;

a cooling source coupled to the electronic display and configured to cool the surrounding environment;

a return vent and a supply vent, at least one of the return vent and the supply vent disposed in a surface of the electronic display, the electronic display, the heat source, and the cooling source sharing a single power source such that the single housing is installable within one or more of an existing fireplace and an existing cabinet as a retrofit with the electronic display and the at least one of the return vent and the supply vent facing out of the one or more of the existing fireplace and the existing cabinet; and a duct disposed at least partially behind the electronic display, the duct directing air from the supply vent past one or more of the heat source and the cooling source and out the return vent.

2. The apparatus of claim 1, wherein the heat source and the cooling source comprise a heat pump configured to heat the surrounding environment in a heating mode and to cool the surrounding environment in a cooling mode.

3. The apparatus of claim 1, further comprising a controller in communication with the heat source, the cooling source, and the electronic display.

4. The apparatus of claim 3, wherein the controller is configured to display a first of the one or more flame visualizations during a heating mode in which the heat source heats the surrounding environment and to display a second of the one or more flame visualizations during a cooling mode in which the cooling source cools the surrounding environment.

5. The apparatus of claim 4, wherein the first of the one or more flame visualizations comprises a warm color hue comprising one or more of a yellow, orange, and red hue and the second of the one or more flame visualizations comprises a cool color hue comprising one or more of a blue, green, and magenta hue.

6. The apparatus of claim 3, further comprising computer program code stored on a non-transitory computer readable storage medium of a mobile computing device, the computer program code executable by the mobile computing device to communicate wirelessly with the controller with commands for one or more of the electronic display, the heat source, and the cooling source based on user input to the mobile computing device.

7. The apparatus of claim 1, wherein the surface comprises a front surface through which the electronic display is visible.

8. The apparatus of claim 7, wherein the front surface comprises a seal with the duct such that the air is forced through one or more of the return vent and the supply vent.

9. The apparatus of claim 1, wherein one or more of the return vent and the supply vents is disposed in one or more side surfaces perpendicular to the electronic display, the one or more side surfaces shaped to extend out of a wall.

10. The apparatus of claim 1, wherein the single power source comprises an electric power source such that the heat source does not use a combustible fuel source to heat the surrounding environment.

11. A system, comprising:

an electric fireplace comprising:

an electronic display configured to display one or more flame visualizations;

a heat source coupled to the electronic display and configured to heat a surrounding environment;

a cooling source coupled to the electronic display and configured to cool the surrounding environment, the electronic display;

a return vent and a supply vent, at least one of the return vent and the supply vent disposed in a surface of the electronic display, the electronic display, the heat source, and the cooling source sharing a single power source such that the single housing is installable within one or more of an existing fireplace and an existing cabinet as a retrofit with the electronic display and the at least one of the return vent and the supply vent facing out of the one or more of the existing fireplace and the existing cabinet; and a duct disposed at least partially behind the electronic display, the duct directing air from the supply vent past one or more of the heat source and the cooling source and out the return vent; and one or more head units spatially offset from the electric fireplace, each of the one or more head units comprising:

an additional heat source configured to heat the surrounding environment; and an additional cooling source configured to cool the surrounding environment.

12. The system of claim 11, wherein the electric fireplace comprises a controller in communication with the heat source, the cooling source, and the electronic display and each of the one or more head units comprises a controller in communication with the additional heat source and the additional cooling source.

13. The system of claim 12, further comprising computer program code stored on a non-transitory computer readable storage medium of a mobile computing device, the computer program code executable by the mobile computing device to communicate wirelessly with both the controller of the electric fireplace and with the controller of each of the one or more head units to send commands for one or more of the electronic display, the heat source, and the cooling source and for one or more of the additional heat source and the additional cooling source based on user input to the mobile computing device.

14. The system of claim 12, wherein the controller of the electric fireplace is configured to display a first of the one or more flame visualizations during a heating mode in which the heat source heats the surrounding environment and to display a second of the one or more flame visualizations during a cooling mode in which the cooling source cools the surrounding environment.

15. The system of claim 14, wherein the first of the one or more flame visualizations comprises a warm color hue comprising one or more of a yellow, orange, and red hue and the second of the one or more flame visualizations comprises a cool color hue comprising one or more of a blue, green, and magenta hue.

16. The system of claim 11, wherein the surface comprises a front surface through which the electronic display is visible.

17. A computer program product comprising computer program code stored on a non-transitory computer readable storage medium, the computer program code executable by a processor to perform operations, the operations comprising:

displaying one or more flame visualizations on an electronic display;

selectively heating a surrounding environment using a heat source coupled to the electronic display; and selectively cooling the surrounding environment using a cooling source coupled to the electronic display, wherein a single housing comprises the electronic display, the heat source, and the cooling source which share a single power source, wherein at least one of a return vent and a supply vent are disposed in a surface of the electronic display such that the single housing is installable within one or more of an existing fireplace and an existing cabinet as a retrofit with the electronic display and the at least one of the return vent and the supply vent facing out of the one or more of the existing fireplace and the existing cabinet.

18. The computer program product of claim 17, wherein the operations further comprise controlling operation of one or more of the electronic display, the heat source, and the cooling source based on user input received by a mobile computing device.

* * * * *